US010961798B2

(12) United States Patent
Garza et al.

(10) Patent No.: US 10,961,798 B2
(45) Date of Patent: Mar. 30, 2021

(54) METHODS OF DISINTEGRATING DOWNHOLE TOOLS CONTAINING CYANATE ESTERS

(71) Applicants: Ramon Garza, Pearland, TX (US); Michael Johnson, Houston, TX (US)

(72) Inventors: Ramon Garza, Pearland, TX (US); Michael Johnson, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/406,743

(22) Filed: May 8, 2019

(65) Prior Publication Data

US 2020/0355035 A1 Nov. 12, 2020

(51) Int. Cl.
*E21B 29/02* (2006.01)

(52) U.S. Cl.
CPC ..... *E21B 29/02* (2013.01)

(58) Field of Classification Search
CPC ..... E21B 29/02
See application file for complete search history.

(56) References Cited

U.S. PATENT DOCUMENTS 5,744,557 A * 4/1998 McCormick ..... B32B 27/06 526/171
6,245,841 B1 6/2001 Yeager et al.
9,057,242 B2 * 6/2015 Mazyar ..... E21B 41/00
9,835,016 B2 * 12/2017 Zhang ..... E21B 43/14
10,144,858 B2 * 12/2018 Kennedy ..... E21B 43/26
2006/0169450 A1 8/2006 Mang et al.
2013/0032357 A1 2/2013 Mazyar et al.
2014/0345875 A1 11/2014 Murphree et al.
2016/0369083 A1 * 12/2016 Khatiwada ..... C08K 3/40
2017/0247598 A1 8/2017 Kennedy et al.
2017/0291222 A1 * 10/2017 Khatiwada ..... E21B 33/12

FOREIGN PATENT DOCUMENTS

EP 0396383 A2 11/1990

OTHER PUBLICATIONS

International Search Report for International Application No. PCT/US2020/031441, International Filing Date May 5, 2020, dated Aug. 12, 2020, 4 pages.
Written Opinion for International Application No. PCT/US2020/031441, International Filing Date May 5, 2020, dated Aug. 12, 2020, 7 pages.

* cited by examiner

*Primary Examiner* — Matthew R Buck
(74) *Attorney, Agent, or Firm* — Cantor Colburn LLP

(57) ABSTRACT

A method for operation in wellbore includes contacting a downhole article comprising a cyanate ester composite with a treatment fluid comprising propylene carbonate at a temperature of about 25° C. to about 300° C.; and disintegrating the downhole article.

13 Claims, 2 Drawing Sheets

METHODS OF DISINTEGRATING DOWNHOLE TOOLS CONTAINING CYANATE ESTERS

BACKGROUND

Downhole constructions including oil and natural gas wells, $CO_2$ sequestration boreholes, etc. often utilize borehole components or tools that, due to their function, are only required to have limited service lives that are considerably less than the service life of the well. After a component or tool service function is complete, it must be removed or disposed of in order to recover the original size of the fluid pathway for uses such as hydrocarbon production and $CO_2$ sequestration. Disposal of components or tools can be accomplished by milling or drilling the component or by tripping the tool out of the borehole. Each of these is generally time consuming and expensive.

Recently, self-disintegrating or interventionless downhole tools have been developed. These tools are made of degradable engineering materials. Instead of milling or drilling operations, these tools can disintegrate when exposed to wellbore fluids. Ideally the tools can degrade rapidly after their function is complete because the sooner the tools disintegrate, the quicker the well can be put on production. To ensure rapid removal, sometimes acidic or basic fluids have to be pumped downhole. Acidic or basic fluids can be corrosive. Therefore, alternative methods of removing a component or tool from a borehole without using corrosive acidic or basic fluids would be well received in the art.

BRIEF DESCRIPTION

A method for operation in wellbore comprises: contacting a downhole article comprising a cyanate ester composite with a treatment fluid comprising propylene carbonate at a temperature of about 25° C. to about 300° C.; and disintegrating the downhole article.

BRIEF DESCRIPTION OF THE DRAWINGS

The following descriptions should not be considered limiting in any way. With reference to the accompanying drawings, like elements are numbered alike.

DETAILED DESCRIPTION

Figure 1A:
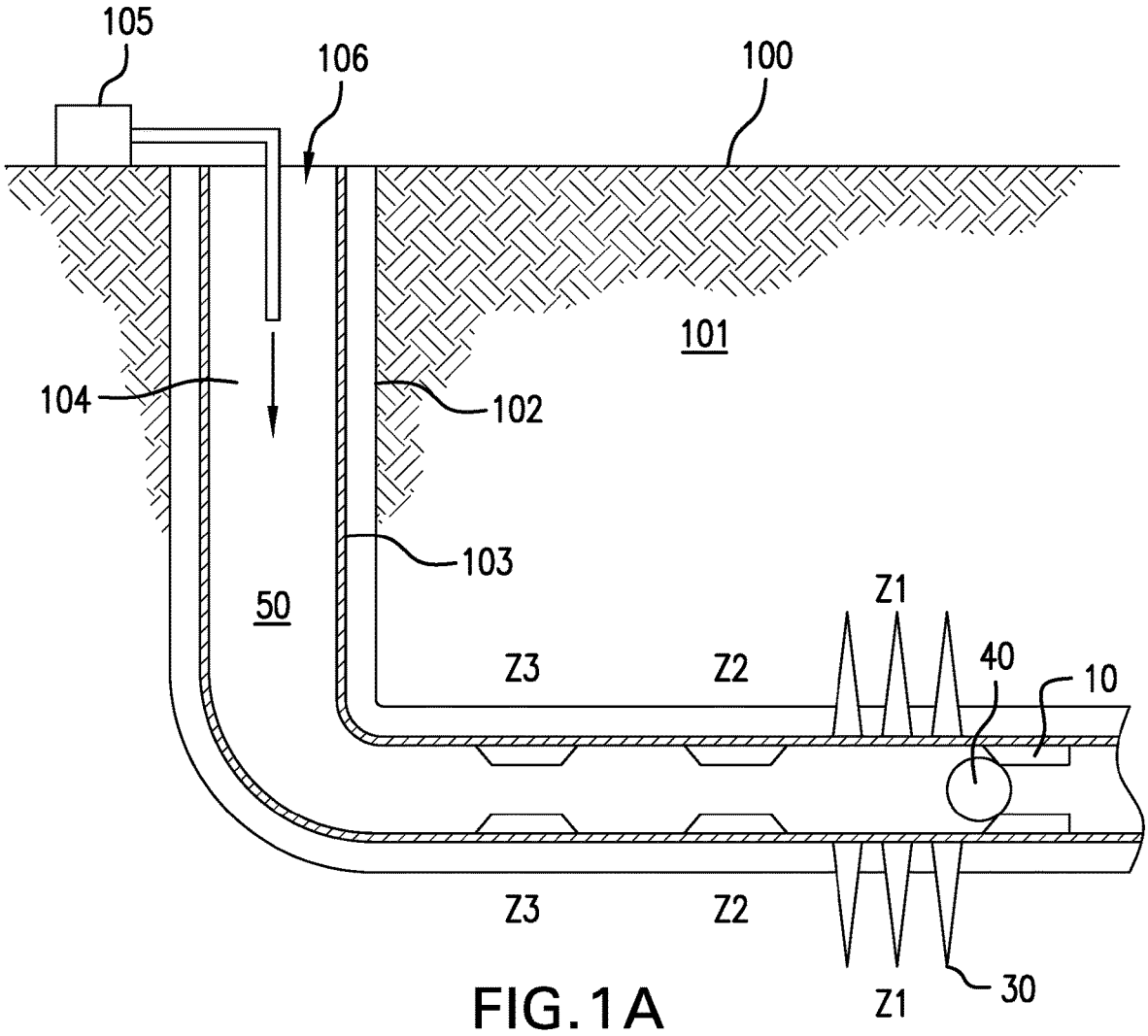
FIG. 1A is a simplified scheme illustrating a process of fracturing or stimulating a first production zone by disposing a system having multiple ball seats in a borehole, engaging a ball with a ball seat, and performing a first fracturing or stimulating operation.

The inventors have found that treatment fluids containing propylene carbonate can facilitate the disintegration of downhole articles comprising cyanate ester composites. Compared to acidic or basic fluids, the treatment fluids disclosed herein are more environmental friendly.

The treatment fluids can include propylene carbonate in an amount of 20 volume percent to 100 volume percent, 40 to 100 volume percent, or 60 to 100 volume percent, or 80 to 60 volume percent, based on the total volume of the treatment fluids.

In addition to propylene carbonate, the treatment fluids can also contain water or a brine. The brine can include a salt such as NaCl, KCl, NaBr, $MgCl_2$, $CaCl_2$, $CaBr_2$, $ZnBr_2$, $NH_4Cl$, sodium formate, cesium formate, and the like. The salt can be present in an amount of from about 0.5 weight percent (wt. %) to about 50 wt. %, specifically about 1 wt. % to about 40 wt. %, and more specifically about 1 wt. % to about 25 wt. %, based on the weight of the treatment fluids.

The treatment fluids can be made by combining water or brine if present with propylene carbonate. In embodiment, the treatment fluids are made by combining propylene carbonate with a completion fluid.

The tools or components made from the cyanate ester composites are able to maintain their mechanical strength. When they are no longer needed, they are contacted with the treatment fluids disclosed herein, and disintegrate thus conveniently removed.

The contacting can be conducted at a temperature of about 25° C. to about 300° C., about 65° C. to about 250° C., about 65° C. to about 150° C., or about 175° C. to about 250° C. The pressure can be about 100 psi to about 15,000 psi.

The tools or components made from the cyanate ester composite can be contact with the treatment fluids in a downhole environment. Preferably, a downhole operation is performed before the downhole article is disintegrated. The downhole operation can be a fracturing operation, a completion operation, a stimulation operation, or a drilling operation. Preferably the downhole operation is a fracturing operation, and the treatment fluids are injected into a wellbore after the fracturing operation.

The cyanate ester composites contain a cyanate ester and an additive. Cyanate esters are compounds generally based on a phenol or a novolac derivative, in which the hydrogen atom of the phenolic OH group is substituted by a cyanide group (—OCN). Suitable cyanate esters include those described in U.S. Pat. No. 6,245,841 and EP 0396383. In an embodiment, cyanate esters are based on resorcinol, p,p'-dihydroxydiphenyl, o,p'-dihydroxydiphenyl methane, 2,2-bis(4-hydroxyphenyl)propane (bisphenol A), tetramethylbisphenol F, hexafluorobisphenol A, bisphenol E, bisphenol M, dicyclopentadienyl bisphenol, o,p'-dihydroxydiphenyl methane, p,p'-dihydroxydiphenyl propane, p,p'-dihydroxydiphenyl sulfone, p,p'-dihydroxydiphenyl sulfide, p,p'-dihydroxydiphenyl oxide, 4,4'-methylenebis(2,6-dimethyl phenol), p,p',p"-tri-hydroxy triphenyl ethane, dihydroxynaphthalene and novolac resins which contain more than 2 phenol moieties per moleculeor, or a combination thereof.

Cyanate esters can be cured and postcured by heating, either alone, or in the presence of a catalyst. Curing normally occurs via cyclotrimerization (an addition process) of three CN groups to form three-dimensional networks comprising triazine rings. The residual cyanate ester content can be determined quantitatively by methods known in the art, for example, by infrared analysis or by "residual heat of reaction" using a differential scanning calorimeter.

As used herein, a "cured cyanate ester" means that cyanate ester monomers are cured until at least about 70 percent, at least about 80 percent, at least about 85 percent, or at least about 90 percent of the cyanate functional groups are cyclotrimerized. The curing reaction can be conducted at about 150° F. to about 600° F. or about 200° F. to about 500° F. If a catalyst is present, the curing temperature can be lower. Suitable curing catalysts include an active-hydrogen catalyst or transition metal complexes of cobalt, copper, manganese and zinc. In an embodiment, the cyanate ester in the composite is a cured cyanate ester.

Exemplary additives include one or more of the following: glass; carbon; CaO; MgO; Mg; Zn; a formate of sodium or potassium; an octoate of Zn or Mn; a naphthenate of Zn or Mn; ararnid fibers; nylon fibers; cellulosic biodegradable fibers; polylactic acids; polyvinyl alcohols; or polyglycolic acids. A combination of glass with 10 to 45 wt % of one or more of the remaining additives can be used.

The glass in the cyanate ester composite can be a "dissolvable glass." As used herein, the term "dissolvable glass" refers to a glass material that has a solubility in water of greater than about 15 grams/100 mL at 25° C. At elevated temperatures, the dissolvable glass can completely dissolve in a short period of time. In an embodiment, the glass as disclosed herein dissolves in 100° C. water in about 2 to 4 hours.

The dissolvable glass comprises about 55 to about 80 wt. % of $SiO_2$, 0 to about 35 wt. % of $Na_2O$, 0 to about 35 wt. % of $K_2O$, 0 to about 20 wt. % of CaO, and 0 to about 10 wt. % of MgO, provided that the sum of the weights of $Na_2O$ and $K_2O$ is about 20 wt. % to about 40 wt. %, about 20 wt. % to about 35 wt. %, or about 22 wt. % to about 33 wt. %, wherein each weight percent is based on the total weight of the dissolvable glass. In an embodiment, the dissolvable glass comprises at least one of sodium silicate or potassium silicate. Preferably the dissolvable glass comprises sodium silicate having a formula of $Na_2O.SiO_2$, wherein the weight percent of $SiO_2$ relative to $Na_2O$ is about 3.22:1 to about 1:1, about 3.22:1 to about 2.5:1, specifically about 2:1 to about 1:1.

The amounts of the cyanate ester and the additive component can be adjusted to balance the disintegration rate and the desirable physical properties. In an embodiment, the weight ratio of the cyanate ester relative to the additive in the polymer composite is about 10:1 to about 1:10, about 5:1 to about 1:5, about 2:1 to about 1:2, or about 2:1 to about 1:1.

Non-limiting examples of the articles include frac balls, shadow frag plugs such as those for perf-and-plug job, dissolvable bridge plugs, dissolvable gas valve plugs, and dissolvable isolation plugs. The polymeric compositions can be used to form the entire plug or can be a support tool. In another embodiment, combinations of the articles are used together. These cost-effective polymer-based tough tools have strengths to bear load during plug applications and dissolve away to create an unobstructed pathway when treated with selective fluid formulations, making perf-and-plug jobs intervention-less operations.

The article can be a downhole tool. In an embodiment, the downhole tool is a single component. In another embodiment the downhole tool inhibits flow. In yet another embodiment, the downhole tool is pumpable within a downhole environment.

Exemplary downhole tools include flappers, hold down dogs and springs, screen protectors, seal bore protectors, electric submersible pump space out subs, full bore guns, chemical encapsulations, slips, dogs, springs and collet restraints, liner setting sleeves, timing actuation devices, emergency grapple release, chemical encapsulation containers, screen protectors, beaded screen protectors, whipstock lugs, whipstock coatings, pins, set screws, emergency release tools, gas generators, mandrels, release mechanisms, staging collars, C-rings, components of perforating gun systems, disintegrable whipstock for casing exit tools, shear pins, dissolvable body locking rings, mud motor stators, progressive cavity pump stators, or shear screws.

Pumpable downhole tools include plugs, direct connect plugs, bridge plugs, wiper plugs, frac plugs, components of frac plugs, drill in sand control beaded screen plugs, inflow control device plugs, polymeric plugs, disappearing wiper plugs, cementing plugs, balls, diverter balls, shifting and setting balls, swabbing element protectors, buoyant recorders, pumpable collets, float shoes, or darts.

The downhole tools that inhibit flow include seals, high pressure beaded frac screen plugs, screen basepipe plugs, coatings for balls and seats, compression packing elements, expandable packing elements, O-rings, bonded seals, bullet seals, sub-surface safety valve seals, sub-surface safety valve flapper seal, dynamic seals, V-rings, back up rings, drill bit seals, liner port plugs, atmospheric discs, atmospheric chamber discs, debris barriers, drill in stim liner plugs, inflow control device plugs, flappers, seats, ball seats, direct connect disks, drill-in linear disks, gas lift valve plug, fluid loss control flappers, electric submersible pump seals, shear out plugs, flapper valves, gaslift valves, or sleeves.

Figure 1B:
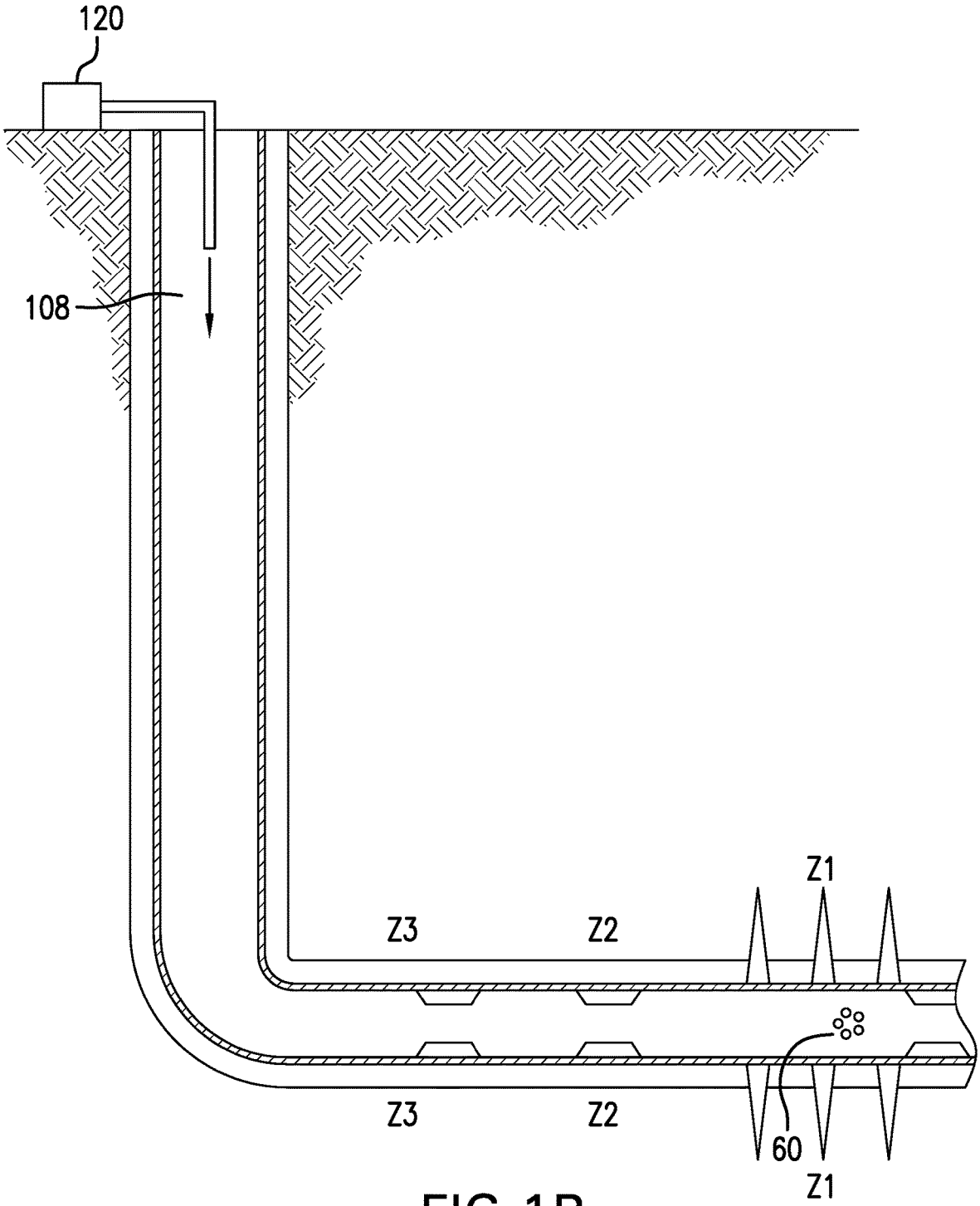
FIG. 1B illustrates the process of removing the ball shown in FIG. 1A using a treatment fluid.

Preferably, the downhole article is a restrictor such as a ball, a plug, or a dart, which when engaged with a restriction such as a ball seat, can block fluid flow. Referring to FIGS. 1A and 1B, a downhole system 106 is disposed in a borehole 102 formed in formation 101 to facilitate the production of oil and gas. The downhole system 106 can be disposed through multiple production zones such as Z1, Z2, and Z3. Borehole 102 may be a vertical well, a horizontal well, a deviated well, or any combination thereof.

The system 106 includes a tubular 103 having a passage 50 and a plurality of perforations (not shown). The system also includes restrictions 10 disposed with the tubular. The shape of the restrictions are not particularly limited as along as the restrictions can accommodate restrictors such as balls, darts, plugs, etc. for blocking fluid flow. In an embodiment, the restrictions have a generally cylindrical shape that tapers in a truncated, conical cross-sectional shape such as a ball seat, to allow, for example, a ball to seat and form a seal in the desired downhole location. In a further embodiment, the surface is milled to have a concave region having a radius designed to accommodate a ball or plug.

In use, downhole article 40 is engaged with restriction 10 to block fluid flow through passage 50. Fracturing or stimulating fluids 104 can then be pumped from a fluid source 105 to flow through the opened perforations creating fractures 30 in production zone Z1.

Referring to FIG. 1B, after a desired operation such as fracturing or stimulating operation is performed in production zone Z1, a treatment fluid 108 as disclosed herein is pumped downhole from a fluid source 120. When the downhole article 40 is contacted with the treatment fluid 108, it is broken into small pieces 60, which is subsequently removed creating an unobstructed fluid pathway.

Set forth are various embodiments of the disclosure.

Embodiment 1. A method for operation in wellbore comprising: contacting a downhole article comprising a cyanate ester composite with a treatment fluid comprising propylene carbonate at a temperature of about 25° C. to about 300° C.; and disintegrating the downhole article.

Embodiment 2. The method as in any prior embodiment, wherein the treatment fluid further comprises water or a brine.

Embodiment 3. The method as in any prior embodiment, wherein the treatment fluid comprises about 20 to about 100 volume percent of the propylene carbonate based on the total volume of the treatment fluid.

Embodiment 4. The method as in any prior embodiment, wherein the downhole article is contacted with the treatment fluid at a pressure of about 100 psi to about 15,000 psi.

Embodiment 5. The method as in any prior embodiment, wherein the downhole article is contacted with the treatment fluid in a downhole environment.

Embodiment 6. The method as in any prior embodiment, further comprising injecting the treatment fluid into a wellbore.

Embodiment 7. The method as in any prior embodiment, wherein the method further comprises performing a downhole operation before disintegrating the downhole article.

Embodiment 8. The method as in any prior embodiment, wherein the downhole operation is a fracturing operation, a completion operation, a stimulation operation, or a drilling operation.

Embodiment 9. The method as in any prior embodiment, wherein the downhole operation is a fracturing operation.

Embodiment 10. The method as in any prior embodiment, further comprising injecting the treatment fluid into a wellbore after the fracturing operation.

Embodiment 11. The method as in any prior embodiment, wherein the cyanate ester composite comprises a cyanate ester and an additive comprising one or more of the following: glass; carbon; CaO; MgO; Mg; Zn; a formate of sodium or potassium; an octoate of Zn or Mn; a naphthenate of Zn or Mn; aramid fibers; nylon fibers; cellulosic biodegradable fibers; polylactic acids; polyvinyl alcohols; or polyglycolic acids.

Embodiment 12. The method as in any prior embodiment, wherein the weight ratio of the cyanate ester to the additive is about 10:1 to about 1:10.

Embodiment 13. The method as in any prior embodiment, wherein the cyanate ester composite comprises dissolvable glass, and about 10 to about 45 wt %, based on the total weight of the cyanate ester composite, of an additive comprising one or more of the following: carbon; CaO; MgO; Mg; Zn; a formate of sodium or potassium; an octoate of Zn or Mn; a naphthenate of Zn or Mn; aramid fibers; nylon fibers; cellulosic biodegradable fibers; polylactic acids; polyvinyl alcohols; or polyglycolic acids.

Embodiment 14. The method as in any prior embodiment, wherein the article is a pumpable downhole tool comprising a plug, a direct connect plug, a bridge plug, a wiper plug, a frac plug, a component of a frac plug, a drill in sand control beaded screen plug, an inflow control device plug, a polymeric plug, a disappearing wiper plug, a cementing plug, a ball, a diverter ball, a shifting and setting ball, a swabbing element protector, a buoyant recorder, a pumpable collet, a float shoe, or a dart.

Embodiment 15. The method as in any prior embodiment, wherein the article is downhole tool that inhibits flow comprising a seal, a high pressure beaded frac screen plug, a screen basepipe plug, a coating for a balls and a seat, a compression packing element, an expandable packing element, an O-ring, a bonded seal, a bullet seal, a sub-surface safety valve seal, a sub-surface safety valve flapper seal, a dynamic seal, a V-ring, a backup ring, a drill bit seal, a liner port plug, an atmospheric disc, an atmospheric chamber disc, a debris barrier, a drill in stim liner plug, an inflow control device plug, a flapper, a seat, a ball seat, a direct connect disk, a drill-in linear disk, a gas lift valve plug, a fluid loss control flapper, an electric submersible pump seal, a shear out plug, a flapper valve, a gaslift valve, or a sleeve.

Embodiment 16. The method as in any prior embodiment, wherein the method comprises: engaging the downhole article with a restriction to block fluid flow; performing a fracturing operation or a stimulation operation; injecting the treatment fluid into the tubular; contacting the downhole article with the treatment fluid; and disintegrating and removing the downhole article.

All ranges disclosed herein are inclusive of the endpoints, and the endpoints are independently combinable with each other. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." Further, it should further be noted that the terms "first," "second," and the like herein do not denote any order, quantity (such that more than one, two, or more than two of an element can be present), or importance, but rather are used to distinguish one element from another. The modifier "about" used in connection with a quantity is inclusive of the stated value and has the meaning dictated by the context (e.g., it includes the degree of error associated with measurement of the particular quantity).

What is claimed is:

1. A method for operation in a wellbore comprising:

injecting a treatment fluid into a wellbore, the treatment fluid comprising 100 volume percent of propylene carbonate based on a total volume of the treatment fluid; and contacting a downhole article comprising a cyanate ester composite with the treatment fluid at a temperature of about 25° C. to about 300° C. to disintegrate the downhole article, wherein the cyanate ester composite comprises cyanate ester;

dissolvable glass, which comprises about 55 wt. % to about 80 wt. % of $SiO_2$, 0 wt. % to about 35 wt. % of $Na_2O$, 0 wt. % to about 35 wt. % of $K_2O$, 0 wt. % to about 20 wt. % of CaO, and 0 wt. % to about 10 wt. % of MgO, provided that the sum of the weights of $Na_2O$ and $K_2O$ is about 20 wt. % to about 35 wt. %, based on a total weight of the dissolvable glass; and about 10 wt. % to about 45 wt. %, based on a total weight of the cyanate ester composite, of an additive comprising one or more of the following: carbon; CaO; MgO; a formate of sodium or potassium; an octoate of Zn or Mn; a naphthenate of Zn or Mn; aramid fibers; nylon fibers; cellulosic biodegradable fibers; polylactic acids; polyvinyl alcohols; or polyglycolic acids.

2. The method of claim 1, wherein the downhole article is contacted with the treatment fluid at a pressure of about 100 psi to about 15,000 psi.

3. The method of claim 1, wherein the downhole article is contacted with the treatment fluid in a downhole environment.

4. The method of claim 1, wherein the method further comprises performing a downhole operation before disintegrating the downhole article.

5. The method of claim 4, wherein the downhole operation is a fracturing operation, a completion operation, a stimulation operation, or a drilling operation.

6. The method of claim 4, wherein the downhole operation is a fracturing operation.

7. The method of claim 6, further comprising injecting the treatment fluid into the wellbore after the fracturing operation.

8. The method of claim 1, wherein the weight ratio of the cyanate ester to the additive is about 10:1 to about 1:10.

9. The method of claim 1, wherein the article is a pumpable downhole tool comprising a plug, a direct connect plug, a bridge plug, a wiper plug, a frac plug, a component of a frac plug, a drill in sand control beaded screen plug, an inflow control device plug, a polymeric plug, a disappearing wiper plug, a cementing plug, a ball, a diverter ball, a shifting and setting ball, a swabbing element protector, a buoyant recorder, a pumpable collet, a float shoe, or a dart.

10. The method of claim 1, wherein the article is downhole tool that inhibits flow comprising a seal, a high pressure beaded frac screen plug, a screen basepipe plug, a coating for a balls and a seat, a compression packing element, an expandable packing element, an O-ring, a bonded seal, a bullet seal, a sub-surface safety valve seal, a sub-surface safety valve flapper seal, a dynamic seal, a V-ring, a backup ring, a drill bit seal, a liner port plug, an atmospheric disc, an atmospheric chamber disc, a debris barrier, a drill in stim liner plug, an inflow control device plug, a flapper, a seat, a ball seat, a direct connect disk, a drill-in linear disk, a gas lift valve plug, a fluid loss control flapper, an electric submersible pump seal, a shear out plug, a flapper valve, a gaslift valve, or a sleeve.

11. The method of claim 1, wherein the method comprises:

engaging the downhole article with a restriction disposed with a tubular to block fluid flow, the tubular having a passage and a plurality of the perforations;

performing a fracturing operation or a stimulation operation;

injecting the treatment fluid into the tubular;

contacting the downhole article with the treatment fluid; and disintegrating and removing the downhole article.

12. The method of claim 1, wherein the contacting is conducted at a temperature of about 65° C. to about 250° C.

13. The method of claim 1, wherein the contacting is conducted at a temperature of about 175° C. to about 250° C.

* * * * *